US009410308B2

(12) United States Patent
Jaye

(10) Patent No.: US 9,410,308 B2
(45) Date of Patent: Aug. 9, 2016

(54) SHOWER ARM LEAK DETECTION DEVICE WITH ADJUSTABLE SLEEVES

(76) Inventor: David Jaye, Maitland, FL (US)

( * ) Notice: Subject to any disclaimer, the term of this patent is extended or adjusted under 35 U.S.C. 154(b) by 1459 days.

(21) Appl. No.: 12/855,251

(22) Filed: Aug. 12, 2010

(65) Prior Publication Data

US 2011/0036420 A1 Feb. 17, 2011

Related U.S. Application Data

(60) Provisional application No. 61/233,895, filed on Aug. 14, 2009.

(51) Int. Cl.
*F16K 23/00* (2006.01)
*E03C 1/04* (2006.01)

(52) U.S. Cl.
CPC ..... *E03C 1/0408* (2013.01); *Y10T 137/698* (2015.04)

(58) Field of Classification Search
CPC ..... E03C 1/0408; Y10T 137/698
USPC ..... 137/312, 313, 360, 375, 377; 285/13, 285/14, 125.1, 129.1
See application file for complete search history.

(56) References Cited

U.S. PATENT DOCUMENTS

| | | | | |
|---|---|---|---|---|
| 3,136,570 | A * | 6/1964 | Lee | 285/193 |
| 4,158,366 | A * | 6/1979 | Van Meter | 137/312 |
| 4,314,580 | A * | 2/1982 | Steinwand | 137/360 |
| 4,473,244 | A * | 9/1984 | Hill | 285/14 |
| 4,836,237 | A * | 6/1989 | McCullough | 137/312 |
| 5,603,347 | A * | 2/1997 | Eaton | 137/360 |
| 5,842,499 | A * | 12/1998 | Hall | 137/360 |
| 6,378,912 | B1 * | 4/2002 | Condon et al. | 285/220 |
| 6,394,125 | B2 * | 5/2002 | White | 137/312 |
| 6,460,432 | B1 * | 10/2002 | Julian et al. | 81/125.1 |
| 6,668,852 | B1 * | 12/2003 | Williamson | 137/312 |
| 2005/0247347 | A1 * | 11/2005 | McNerney | 137/360 |
| 2009/0056815 | A1 * | 3/2009 | Fitzpatrick | 137/15.17 |

* cited by examiner

*Primary Examiner* — Jessica Cahill
(74) *Attorney, Agent, or Firm* — Matthew G. McKinney, Esq.; Allen, Dyer, Doppelt, Milbrath & Gilchrist, P.A.

(57) ABSTRACT

A shower arm leak detection device with adjustable sleeves is disclosed. In a particular embodiment, the shower arm leak detection device includes a tubular sleeve having a first end and a second end, where the first end is adapted to be secured over a drop ear 90° plumbing fitting on an interior side of a wall and the second end is adapted to be open to an exterior side of the wall. The drop ear 90° fitting includes a port adapted to be secured to a shower arm, where a connection at the port and threading of the shower arm is susceptible to leakage. An outer sleeve is adapted to slide partially over the tubular sleeve, where the outer sleeve allows for adjustment to the width between the connection of the port and the shower arm and the exterior side of the wall in telescoping fashion.

16 Claims, 4 Drawing Sheets

SHOWER ARM LEAK DETECTION DEVICE WITH ADJUSTABLE SLEEVES

I. CROSS-REFERENCE TO RELATED APPLICATIONS

This application claims the benefit of U.S. Provisional Application No. 61/233,895 filed Aug. 14, 2009. The disclosure of the provisional application is incorporated herein by reference.

II. FIELD

The present invention relates generally to plumbing fittings, and more specifically to providing a shower arm leak detection device with adjustable sleeves that prevents water that is leaking undetected at a shower arm plumbing fitting from causing water damage to other property.

III. DESCRIPTION OF RELATED ART

There have been attempts to address leaks from water fittings such as Patent Publication No. 2001/0035209 to White, which includes a combination sheath and frost-resistant wall hydrant having an internal valve seat between a bracket and indoor or inlet end. The sheath telescopes over the hydrant's inlet end until the sheath's leading end mates against the hydrant's bracket. A shortcoming of White is that it is not adapted to be secured to a drop ear 90° or similar water fitting typically used in residential homes for connecting a water supply to a shower arm.

Another example is U.S. Pat. No. 5,603,347 to Eaton, which is similar to White for use with a sillcock (i.e., hydrant). The housing of the sillcock includes a tube, a valve within the tube and a control knob at one end of the tube to operate the valve. The housing has an internal chamber for receiving the pipeline for the sillcock. A shortcoming of Eaton is that it is not adapted to be used with plumbing fittings used in residential homes for connecting a shower arm.

Yet another example is U.S. Pat. No. 6,668,852, to Williamson, which discloses a service sleeve coupled to a frost proof sillcock to prevent damage to a wall of a structure caused by a ruptured sillcock. Similar to the shortcomings of White and Eaton described above, a shortcoming of Williamson is that it is not adapted to be secured to a drop ear 90° type water fitting typically used in residential homes for connecting a water supply to a shower arm.

Still yet another example is U.S. Pat. No. 5,983,924 to Hodgkinson, which is a water diverting device for directing leaking water from a plumbing fitting from behind a wall to the front face of the wall. A shortcoming of Hodgkinson, is the securement of the water diverter to a water supply fitting. As shown in FIG. 1 of Hodgkinson, the diverter is loosely placed over the fitting and held in place by the angled flange 18 engaging a raised surface of the fitting. However, not all fittings have a raised surface or a significant raised portion making the diverter of Hodgkinson susceptible to being inadvertently pulled out of position and rendered useless. Accordingly, what is needed is an adjustable shower arm sleeve that is adapted to be snugly secured over a drop ear 90° fitting and is not susceptible to being unintentionally removed or jostled out of position.

IV. SUMMARY

In a particular embodiment, a shower arm leak detection device with adjustable sleeves is disclosed to be used with a drop ear 90° type fitting and a shower arm. The shower arm is susceptible to leaks where it is connected to a water supply behind a wall (which is hidden from view) using a drop ear 90° fitting. That hidden connection may leak over time without detection causing damage within the wall. The adjustable shower arm sleeve includes a tubular sleeve having a first end and a second end, where the first end is adapted to be secured over the drop ear 90° plumbing fitting on an interior side of the wall and the second end is adapted to be open to an exterior side of the wall. The drop ear 90° fitting includes a port adapted to be secured to a shower arm, where a connection at the port and threading of the shower arm is susceptible to leakage. An outer sleeve is adapted to slide partially over the tubular sleeve, where the outer sleeve allows for adjustment to the width between the connection of the port and the shower arm and the exterior side of the wall in telescoping fashion. Accordingly, if the shower arm connection is leaking water within the wall, the adjustable shower arm sleeve catches the leaking water and directs it out of the wall and into the shower area.

Other aspects, advantages, and features of the present disclosure will become apparent after review of the entire application, including the following sections: Brief Description of the Drawings, Detailed Description, and the Claims.

V. BRIEF DESCRIPTION OF THE DRAWINGS

Figure 5:
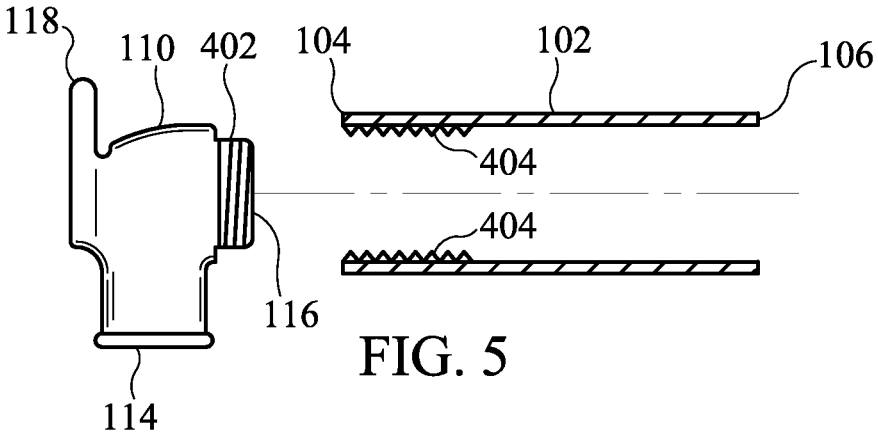
Figure 6:
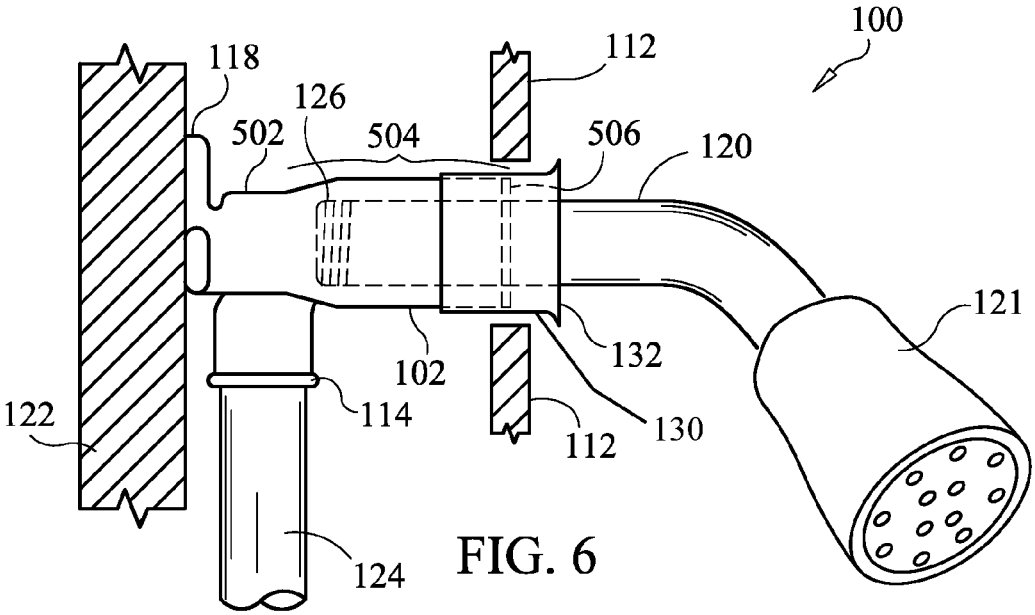

FIG. 5 is a cross sectional view of a particular embodiment of the shower arm leak detection device with adjustable sleeves showing internal threading for securing over the modified drop ear 90° plumbing fitting having external threading; and FIG. 6 is a side view of a particular illustrative embodiment of the shower arm leak detection device with adjustable sleeves secured to a drop ear 90° plumbing fitting having a second port.

VI. DETAILED DESCRIPTION

Figure 1:
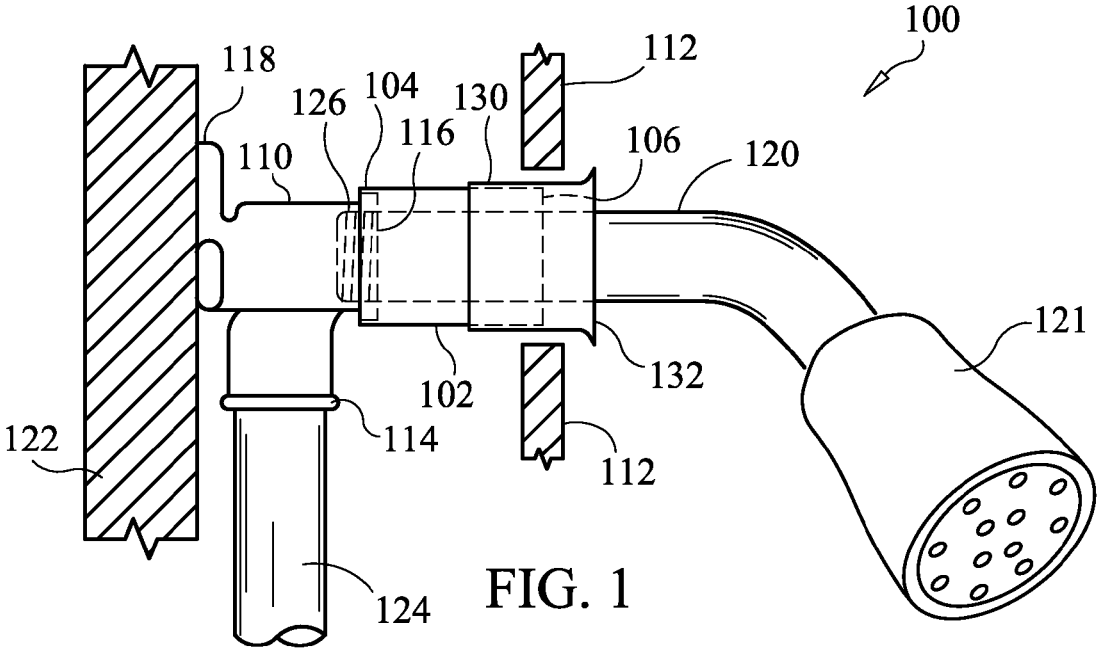
FIG. 1 is a side view of a particular illustrative embodiment of a shower arm leak detection device with adjustable sleeves shown secured to a prior art drop ear 90° plumbing fitting.

Referring to FIG. 1, a particular illustrative embodiment of a shower arm leak detection device with adjustable sleeves is disclosed and generally designated 100. The adjustable shower arm sleeve 100 includes a tubular sleeve 102 having a first end 104 and a second end 106, where the first end 104 is secured over a drop ear 90° plumbing fitting 110 and the second end 106 is open to the interior face of a shower stall wall 112. The drop ear 90° fitting 110 has a first port 114 that is secured to a water supply line 124 and a second port 116 that is secured to a shower arm 120. A shower head 121 may be secured to the shower arm as shown in FIGS. 1, 3, 4 and 6. The connection at the second port 116 between the drop ear 90° fitting 110 and threading 126 of the shower arm 120 is susceptible to leakage that can begin from the time of installation and go undetected for years. The first end 104 of the tubular sleeve 102 is adapted to fit over the second port 116 of the drop ear 90° fitting 110. Tabs 118 at the periphery of the drop ear 90° fitting 110 are used to secure the drop ear 90° fitting 110 to an interior wall structure 122. The water supply line 124 is secured to the drop ear 90° fitting 110 at the first port 114 typically in a vertical orientation making a watertight connection. Similarly, the shower arm 120 is secured to the second port 116 of the drop ear 90° fitting 110 typically in a horizontal orientation.

An outer sleeve 130 is adapted to slide partially over the tubular sleeve 102 that fits on the drop ear 90° fitting 110. The outer sleeve 130 allows for adjustment to the width between the interior wall structure 122 and the interior face of the shower area wall 112 that is being protected at the threaded connection of the shower arm 120 onto the drop ear 90° fitting 110. There is a water tight connection between the tubular sleeve 102 and the exterior of the drop ear 90° fitting 110 using a friction fit, sealant, a gasket, or other similar means, or the connection may be welded.

Figure 3:
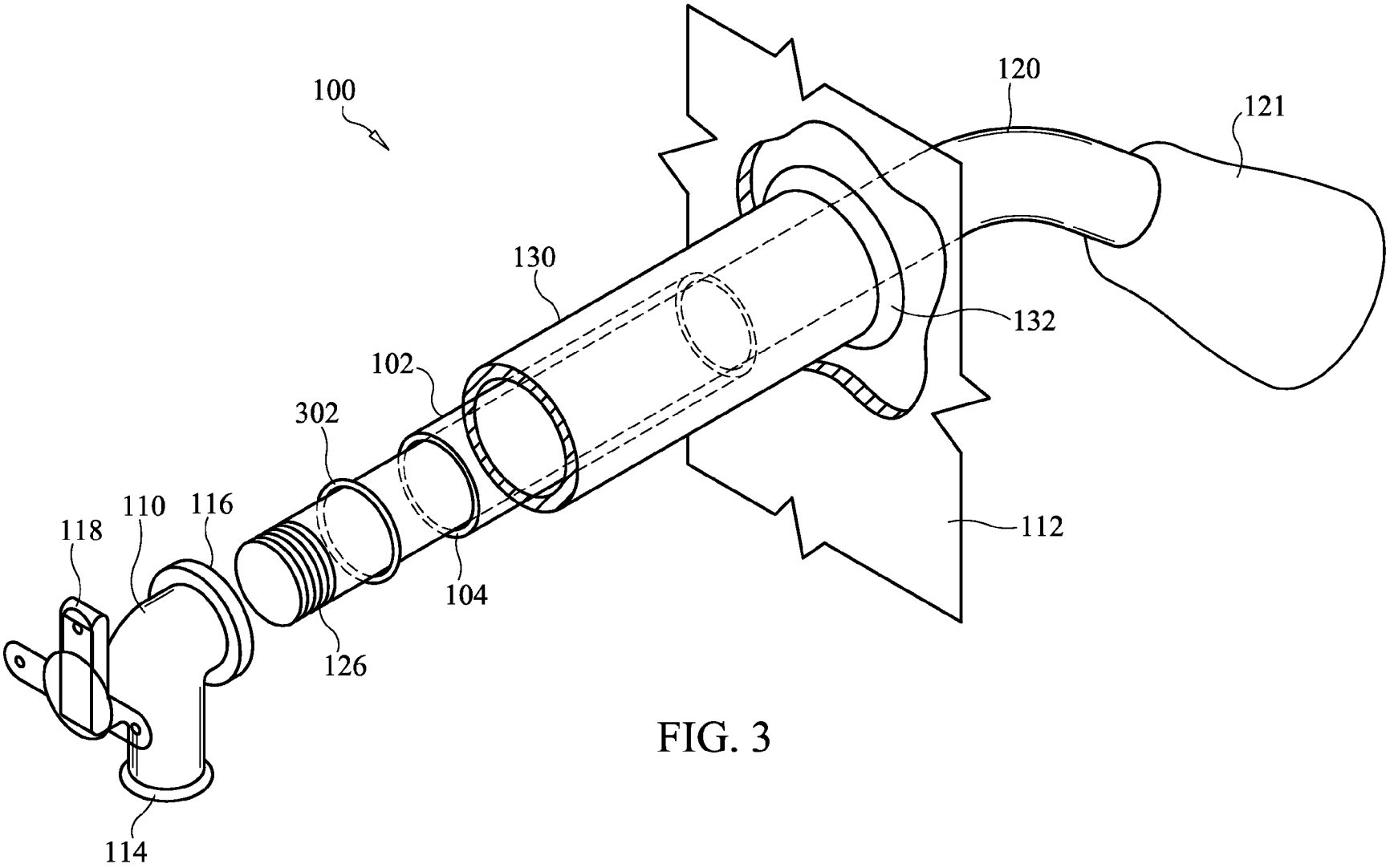
FIG. 3 is a partial cut away view of a particular illustrative embodiment of the shower arm leak detection device with adjustable sleeves.
Figure 4:
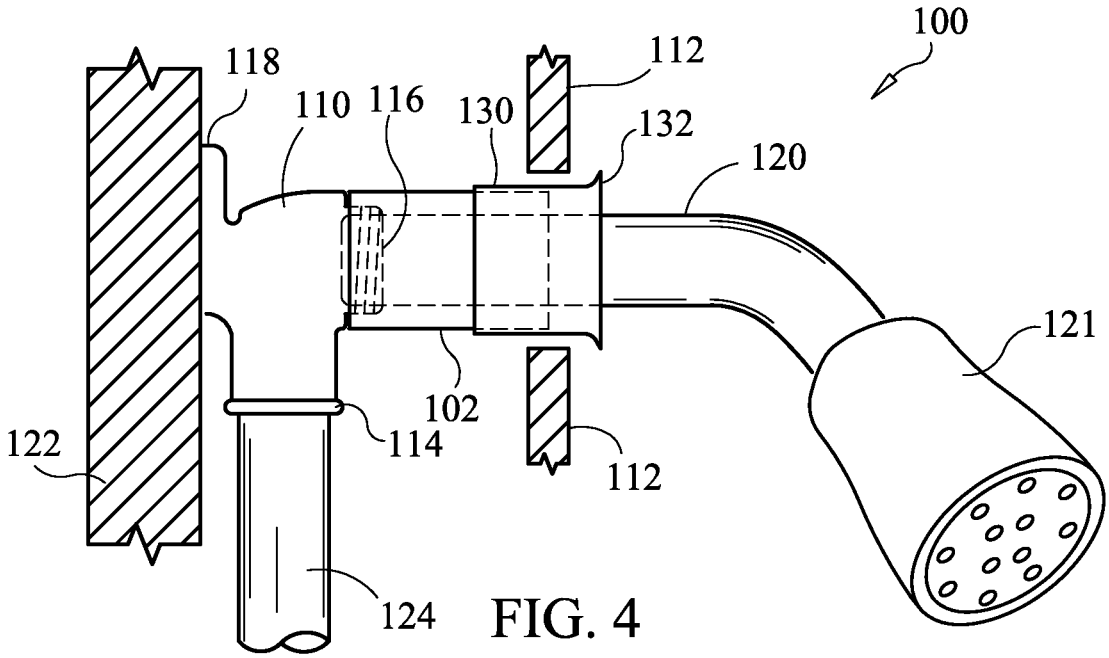
FIG. 4 is a side view of a particular illustrative embodiment of the shower arm leak detection device with adjustable sleeves secured to a modified drop ear 90° plumbing fitting having external threading.

The connection at the drop ear 90° fitting 110 to the shower arm 120 is the problem area that the adjustable shower arm sleeve 100 protects against. The connection may leak undetected behind the wall 112 and cause mold and water damage. The tubular sleeve 102 may not be flanged at its second end 106 but the outer sleeve 130 may have a flange 132 as illustrated in FIGS. 1, 3 and 4. The outer sleeve 130 and the tubular sleeve 102 have a water tight connection to each other using a friction fit, sealant, a gasket or other similar means. Accordingly, any water leaking at the connection between the shower arm 120 and the drop ear 90° fitting 110 is collected by the sleeve 102 and directed to the interior of the shower stall wall 112. Thus, water leaking from the connection between the shower arm 102 and the drop ear 90° 110 is prevented from traveling down behind the wall 112 and causing damage and instead the device 100 directs the water harmlessly to the shower bathing area.

The adjustable shower arm sleeve 100 may be manufactured or adapted to fit a plurality of different outside diameters of existing drop ear 90° fittings that are in the walls of most homes. The tubular sleeve 102 may be different shapes in addition to being round. The diameter of the tubular sleeve 102 may be reduced using a selected size of coupling or gasket that fits inside the tubular sleeve 102 to fit appropriately over the second port 116 of the drop ear 90° fitting 110. The outer sleeve 130 may be flanged at the front edge of the shower wall 112 and adapted to slide onto the outside of the tubular sleeve 130. The adjustable shower arm sleeve 100 provides the advantage of protecting against leaking water from the threaded connections inside a wall that cannot otherwise be readily detected.

Figure 2:
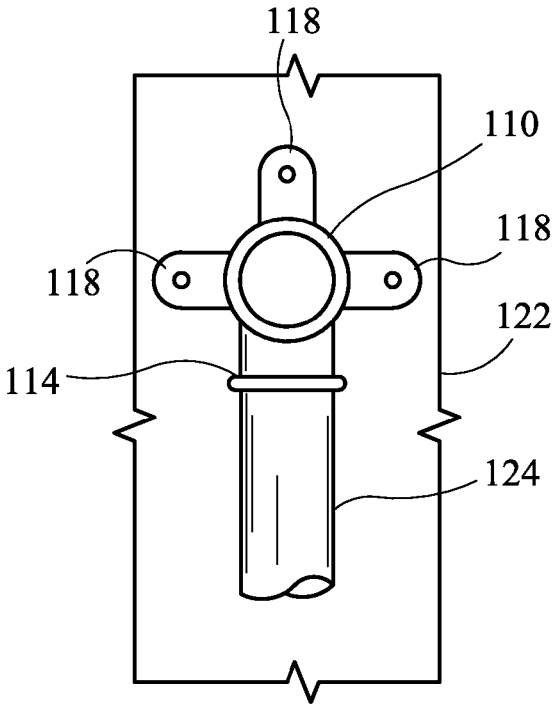
FIG. 2 is a front view of the drop ear 90° plumbing fitting secured to a water supply line used in conjunction with the shower arm leak detection device with adjustable sleeves shown in FIG. 1.

A front view of the drop ear 90° plumbing fitting 110 is shown in FIG. 2 secured to the interior wall structure 122. A plurality of tabs 118 secure the drop ear 90° fitting 110 in position to the interior wall structure 122 using nails, screws, or other securement means. The water supply line 124 provides water to the shower arm 120 via the first port 114 of the drop ear 90° fitting 110. The shower arm 120 is not shown in FIG. 2 for clarity.

Referring now to FIG. 3, the tubular sleeve 102 is shown with a gasket 302 at the first end 104 of the sleeve 102. The gasket 302 is adapted to provide a water-tight friction fit between the sleeve 102 and the second port 116 of the drop ear 90° fitting 110. As discussed above, the gasket is selected to fit inside the tubular sleeve 102 to provide a watertight connection between the tubular sleeve 102 and the exterior of the drop ear 90° fitting 110. The length of the shower arm sleeve 100 is adjustable to a plurality of different depths of walls. The tubular sleeve 102 may be manufactured or cut to a length so that it is approximately flush with the front edge of the shower wall 112. The sleeve 102 may be comprised of one segment as shown in FIG. 3, or of multiple segments that can be joined together to adjust the length of the shower arm sleeve 100. For example, the outer sleeve 130 is adapted to slide over the tubular sleeve 102 and adjust in telescoping fashion. A flange 132 may be disposed on one end of outer sleeve 130 and is approximately flush with the outer surface of the wall 112.

As shown in FIGS. 4 and 5, an alternative embodiment of the shower arm leak detection device with adjustable sleeves 100 is used with a modified drop ear 90° plumbing fitting 110, which has external threading 402 on the exterior surface of the second port 116. The prior art drop ear 90° fittings typically include internal threading only for receiving the shower arm 120. However, the modified drop ear 90° fitting 110 includes external threading 402, which is adapted to mate with the interior threading 404 on the interior surface of the sleeve 102, that is proximate to the first end 104 of sleeve 102. The modified drop ear 90° fitting 110 will also include standard interior threading for attaching the shower arm 120. The first end 104 is secured to the modified drop ear 90° plumbing fitting 110 and the second end 106 is open to the interior face of the shower stall wall 112. The modified drop ear 90° fitting 110 has a first port 114 that is secured to the water supply line 124 and a second port 116 that is secured to the shower arm 120. The tabs 118 at the periphery of the modified drop ear 90° fitting 110 are used to secure it to the interior wall structure 122. The water supply line 124 is secured to the modified drop ear 90° fitting 110 at the first port 114 in a vertical orientation making a watertight connection. The shower arm 120 is secured to the second port 116 of the modified drop ear 90° fitting 110 in a horizontal orientation. Water leaking at the connection between the shower arm 120 and the modified drop ear 90° fitting 110 is collected by the sleeve 102 and directed to the interior of the shower stall wall 112, thereby preventing water damage behind the wall 112. The outer sleeve 130 may also be used if necessary and it is adapted to slide over the tubular sleeve 102 and adjust in telescoping fashion as described above. The outer sleeve 130 allows for the adjustment to the depth of the wall 112 that is being protected at the connection between the shower arm 120 onto the modified drop ear 90° fitting 110.

Referring now to FIG. 5, the tubular sleeve 102 is shown with the internal threading 404 at the first end 104 of the sleeve 102. The internal threading 404 is adapted to mate with the external threading 402 on the modified drop ear 90° fitting 110. The connection provides a water-tight connection between the sleeve 102 and the modified drop ear 90° fitting 110. The length of tubular sleeve 102 may be cut to be flush with the shower wall 112. The shower arm leak detection device with adjustable sleeves 100 may be comprised of one segment as shown in FIG. 5, or of multiple segments using the outer sleeve 130 that can be joined together to adjust the over length of the adjustable shower arm sleeve 100 as illustrated in FIG. 4.

Another illustrative embodiment of the shower arm leak detection device is shown in FIG. 6. The device includes an elongated second port 504 that is adapted to be secured to a shower arm 120. As described above, tabs 118 at the periphery of the drop ear 90° fitting 502 are used to secure the drop ear 90° fitting 502 to an interior wall structure 122. The water supply line 124 is secured to the drop ear 90° fitting 502 at the first port 114. An outer sleeve 130 is adapted to slide partially over the elongated second port 504 and its end 506. The outer sleeve 130 allows for adjustment to the width between the interior wall structure 122 and the interior face of the shower area wall 112. The outer sleeve 130 may have a flange 132. The outer sleeve 130 and the elongated second port 504 have a water tight connection to each other using a friction fit, sealant, a gasket or other similar means. Accordingly, any water leaking at the connection between the shower arm 120 and the drop ear 90° fitting 502 is directed to the interior of the shower stall wall 112.

The previous description of the disclosed embodiments is provided to enable any person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined by the following claims.

What is claimed is:

1. A shower arm leak detection device, the shower arm leak detection device comprising:

a tubular sleeve having a first end and a second end, wherein the first end is configured to be secured over a drop ear 90° plumbing fitting on an interior side of a wall; and an outer sleeve configured to slide partially over the tubular sleeve, wherein the outer sleeve allows for telescoping adjustment to a width between a connection of the drop ear 90° fitting and an exterior side of the wall.

2. The shower arm leak detection device of claim 1, wherein the drop ear 90° fitting comprising:

a first port configured to be secured to a water supply line; and a second port configured to be secured to a shower arm, wherein a connection at the second port between the drop ear 90° fitting and threading of the shower arm is susceptible to leakage.

3. The shower arm leak detection device of claim 2, wherein the first end of the tubular sleeve is configured to fit over an exterior surface of the second port of the drop ear 90° fitting.

4. The shower arm leak detection device of claim 3, wherein the drop ear 90° fitting further comprising tabs about its periphery configured to secure the drop ear 90° fitting to an interior wall structure.

5. The shower arm leak detection device of claim 4, wherein the water supply line is configured to be secured to the drop ear 90° fitting at the first port making a watertight connection.

6. The shower arm leak detection device of claim 5, wherein the outer sleeve further comprising a flange about its end.

7. The shower arm leak detection device of claim 6, wherein the outer sleeve and the tubular sleeve are configured to maintain a water tight connection to each other.

8. The shower arm leak detection device of claim 7, wherein any leaking water at the connection between the shower arm and the drop ear 90° fitting is adapted to be collected by the tubular sleeve and directed to the exterior side of the wall to prevent the leaking water from traveling down behind the interior side of the wall and cause damage.

9. The shower arm leak detection device of claim 8, wherein the tubular sleeve is configured to fit a plurality of different outside diameters of existing drop ear 90° fittings.

10. The shower arm leak detection device of claim 9, wherein the diameter of the tubular sleeve is configured to be reduced to fit snugly over the drop ear 90° fitting.

11. The shower arm leak detection device of claim 10, wherein a plurality of tabs are configured to secure the drop ear 90° fitting in position.

12. The shower arm leak detection device of claim 11, further comprising a gasket proximate the first end of the sleeve and configured to provide a water-tight friction fit between the sleeve and the drop ear 90° fitting, wherein the gasket is selected to fit inside the tubular sleeve to provide a watertight connection between the tubular sleeve and the exterior of the drop ear 90° fitting.

13. The shower arm leak detection device of claim 12, wherein the tubular sleeve is manufactured or cut to a length approximately flush with the exterior side of the wall.

14. A shower arm leak detection device, the shower arm leak detection device comprising:

a tubular sleeve having a first end and a second end, wherein the first end is configured to be secured over a modified drop ear 90° plumbing fitting on an interior side of a wall;

interior threading on an interior surface of the tubular sleeve is configured to mate with external threading on a second port of the modified drop ear 90° fitting; and an outer sleeve configured to slide partially over the tubular sleeve, wherein the outer sleeve allows for telescoping adjustment to a width between a connection of the drop ear 90° fitting and the exterior side of a wall.

15. The shower arm leak detection device of claim 14, wherein the outer sleeve and the tubular sleeve are configured to maintain a water tight connection to each other.

16. A shower arm leak detection device, the shower arm leak detection device comprising:

an elongated port configured to slide over a shower arm, wherein the elongated port having internal threading for receiving the shower arm; and an outer sleeve configured to fit over the elongated port, wherein the outer sleeve allows for telescoping adjustment to a width between a connection of the elongated port and an exterior side of a wall.

* * * * *